US006168477B1

(12) United States Patent
Shih et al.

(10) Patent No.: US 6,168,477 B1
(45) Date of Patent: Jan. 2, 2001

(54) ELECTRICAL CONNECTOR

(75) Inventors: Kelly Shih; Allen Chiu, both of Tu-Chen (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/419,389

(22) Filed: Oct. 15, 1999

(30) Foreign Application Priority Data

May 6, 1999 (TW) ..... 88207167

(51) Int. Cl.[7] ..... H01R 13/41
(52) U.S. Cl. ..... 439/733.1; 439/79
(58) Field of Search ..... 439/733.1, 79, 439/83, 570

(56) References Cited

U.S. PATENT DOCUMENTS 5,667,392 * 9/1997 Kocher et al. ..... 439/733.1
5,674,078 * 10/1997 Davis et al. ..... 439/79
5,704,808 * 1/1998 Chishima ..... 439/83
5,951,335 * 9/1999 Kurotori et al. ..... 439/733.1

* cited by examiner

*Primary Examiner*—Gary F. Paumen
(74) *Attorney, Agent, or Firm*—Wei Te Chung

(57) ABSTRACT

An electrical connector comprises a housing and a number of contacts received in the housing. The housing has a base portion forming a mounting surface, a closed rear face and a front face. A number of cavities is defined in the mounting surface and is exposed to the closed rear face. A partition, extending along a front-rear direction of the base portion, is formed in each cavity. The partition divides the cavity into first and second chambers. Each contact includes a blade portion, a fixing post and a contact tail substantially parallelly extending from the blade portion. The fixing post forms a pair of barbs extending toward the contact tail. The contact tail forms a terminating portion perpendicularly extending from a free end thereof for contacting to a printed circuit board. The fixing post and the contact tail are respectively received in the first chamber and the second chamber.

1 Claim, 6 Drawing Sheets

ELECTRICAL CONNECTOR

FIELD OF THE INVENTION

The present invention is related to a battery connector, and especially to a battery connector mounted on a printed circuit board and having a housing with improved rigidity.

BACKGROUND OF THE INVENTION

An electrical connector has a plurality of contacts for electrically transmitting signals and a housing for receiving the contacts. The art related to the present invention is disclosed in Taiwan Patent Application Nos. 84210634, 83107591, 83209060 and 85213851 and U.S. Pat. No. 5,674,078.

Referring to FIG. 1, a conventional electrical connector 100 includes a plurality of contacts 102 (only one shown for simplicity) and a housing 104 for receiving the contacts 102. The housing 104 includes a plurality of partitions 105 and thin connecting walls 107 to define cavities 106 between a rear surface 108 and a front surface 110 thereof for receiving the contacts 102. A right sidewall 112 of each cavity 106 forms a notch 114 exposed to the rear surface 108. Each contact 102 has a base portion 116 and a blade portion 118 extending from the base portion 116. A tab 120 perpendicularly extends from the base 116 and forms two barbs 122 for being interferentially fit into the notch 114.

However, since the cavities 106 are laterally defined through the housing 104, the housing 104 can be easily warped around a direction M and the partitions 105 can be easily deformed thereby complicating assembly of the contacts 102 into the cavities 106. Furthermore, since each right sidewall 112 of the cavity 106 forms a notch 114, the rigidity of the partition 105 is reduced and the engagement between the contact 102 and the housing 104 is weakened.

SUMMARY OF THE INVENTION

Accordingly, an object of the present invention is to provide an electrical connector having a housing with improved rigidity thereby ensuring reliable assembly of contacts attached therein.

An electrical connector of the present invention comprises a housing and a plurality of contacts received in the housing. The housing has a base portion forming a mounting surface, a closed rear face and a front face. A plurality of cavities is defined in the mounting surface and is exposed to the front surface. A partition, extending along a front-rear direction of the housing, is formed in each cavity to divide the cavity into a first chamber and a second chamber. Each contact includes a blade portion, a fixing post and a contact tail substantially parallelly extending from an edge of the blade portion. The fixing post forms at least one barb extending toward the contact tail to interferentially engage with the partition to secure the contact in the housing. The contact tail is received in the first chamber and forms a terminating portion perpendicularly extending from a free end thereof for electrically connecting with a printed circuit board.

Other objects of the present invention can be drawn from the following description.

DETAILED DESCRIPTION OF THE PREFERRED EMBODIMENT

Figure 1:
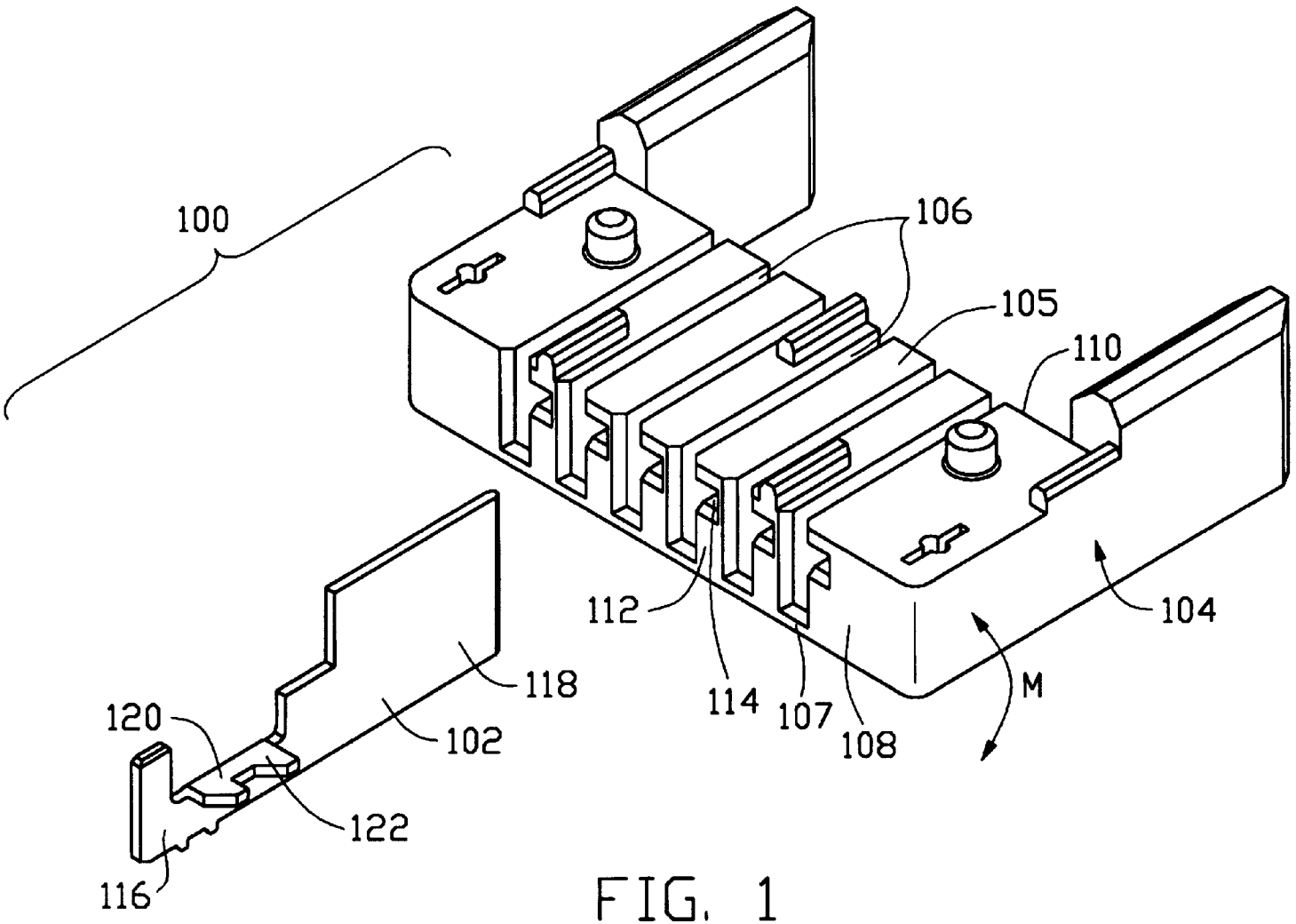
FIG. 1 (PRIOR ART)
FIG. 1 is a rear exploded view of a conventional electrical connector.
Figure 2:
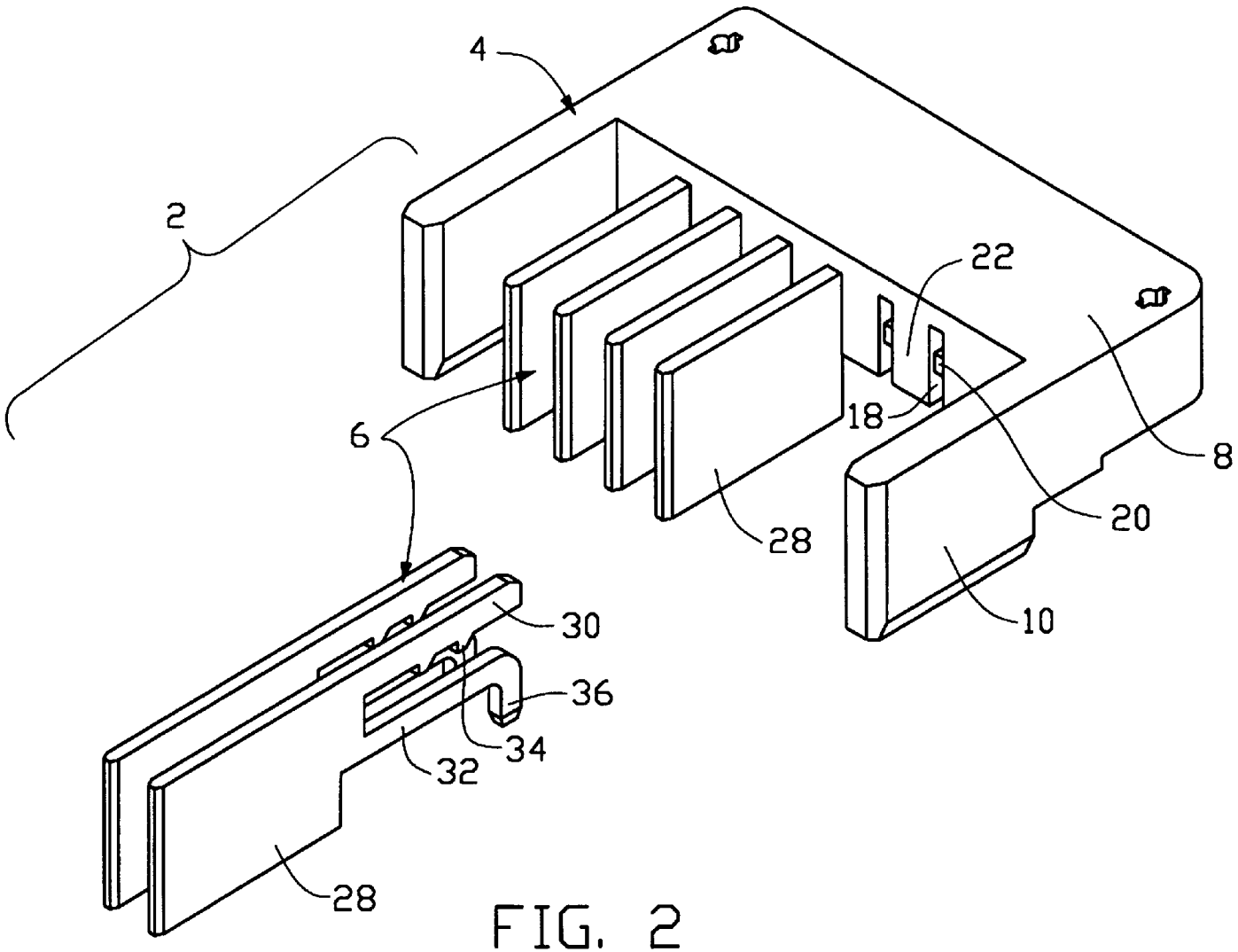
FIG. 2 is a perspective view of an electrical connector embodying the concepts of the present invention with two contacts removed therefrom.
Figure 3:
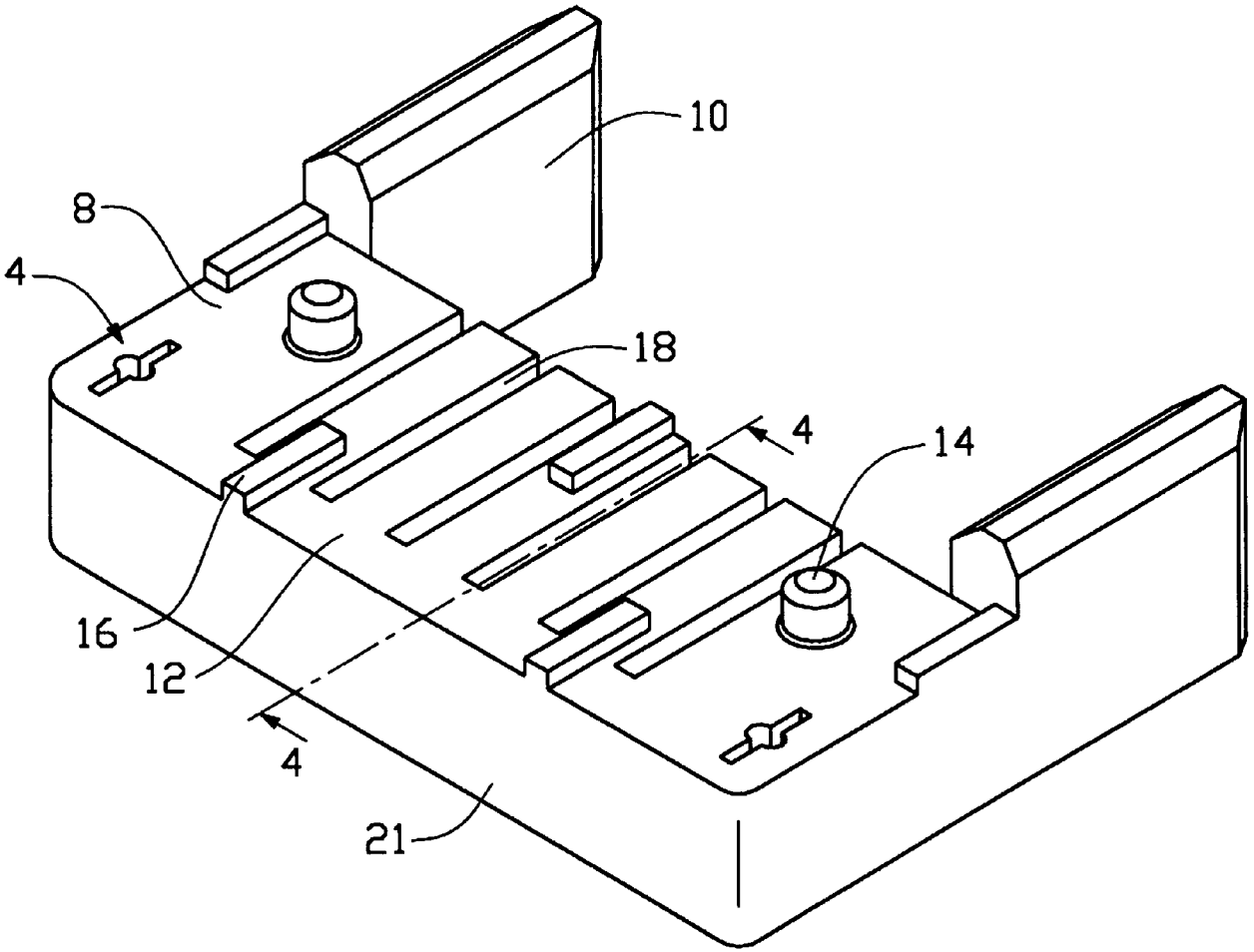
FIG. 3 is a perspective view of a housing of FIG. 2.
Figure 4:
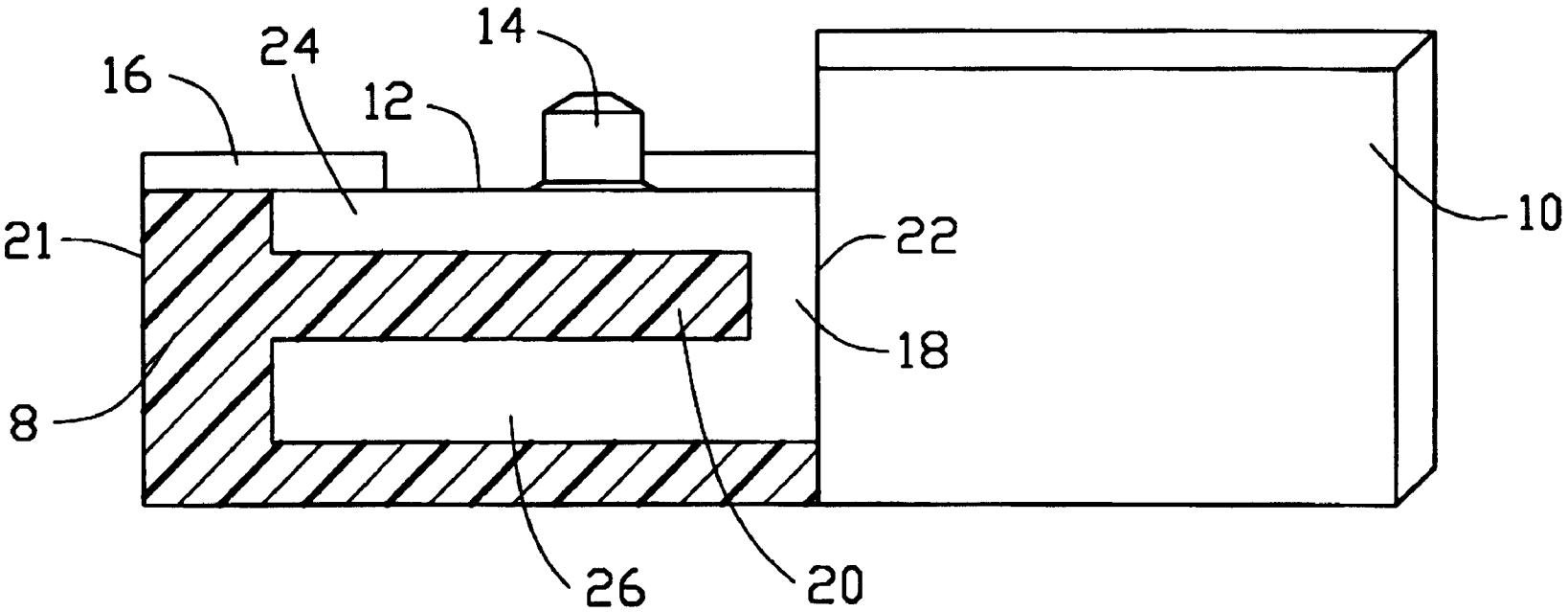
FIG. 4 is a cross sectional view taken along line 4—4 of FIG. 3.

Referring to FIGS. 2–4, an electrical connector 2 of the present invention comprises a housing 4 and a plurality of contacts 6 received in the housing 4. The housing 4 comprises a base portion 8 and a pair of arms 10 extending from opposite sides of the base portion 8 for engaging with a complementary connector (not shown). The base portion 8 forms a mounting surface 12, a closed rear face 21 and a front face 22. A pair of alignment posts 14 and a plurality of standoffs 16 are formed in the mounting surface 12 for properly positioning the electrical connector 2 on a printed circuit board (not shown). A plurality of cavities 18 is defined in the mounting surface 12 and is substantially exposed to the front face 22 for receiving the contacts 6. Each cavity 18 does not traverse the closed rear face 21 of the base portion 8, thereby enhancing the rigid of the housing 4. A partition 20, extending in a front-rear direction of the housing 4, is formed in each cavity 18. The partition 20 is generally positioned in an intermediate portion of each cavity 18 and is spaced a predetermined distance from the front face 22 of the base 4. The partition 20 divides the cavity 18 into a first chamber 24 exposed to the mounting surface 12 and a second chamber 26.

Each contact 6 includes a blade portion 28, a fixing post 30 and a contact tail 32 substantially extend in parallel from an edge of the blade portion 28. A gap is defined between the fixing post 30 and the contact tail 32 which is substantially larger than a width of the partition 20 of the housing 4. The fixing post 30 forms at least one barb 34 extending toward the contact tail 32 and spaced a predetermined distance from the blade portion 28 to interferentially engage with the partition 20 to secure the contact 6 in the housing 4. The contact tail 32 is received in the first chamber 24 and forms a terminating portion 36 perpendicularly extending from a free end thereof for contacting to the printed circuit board.

Figure 5:
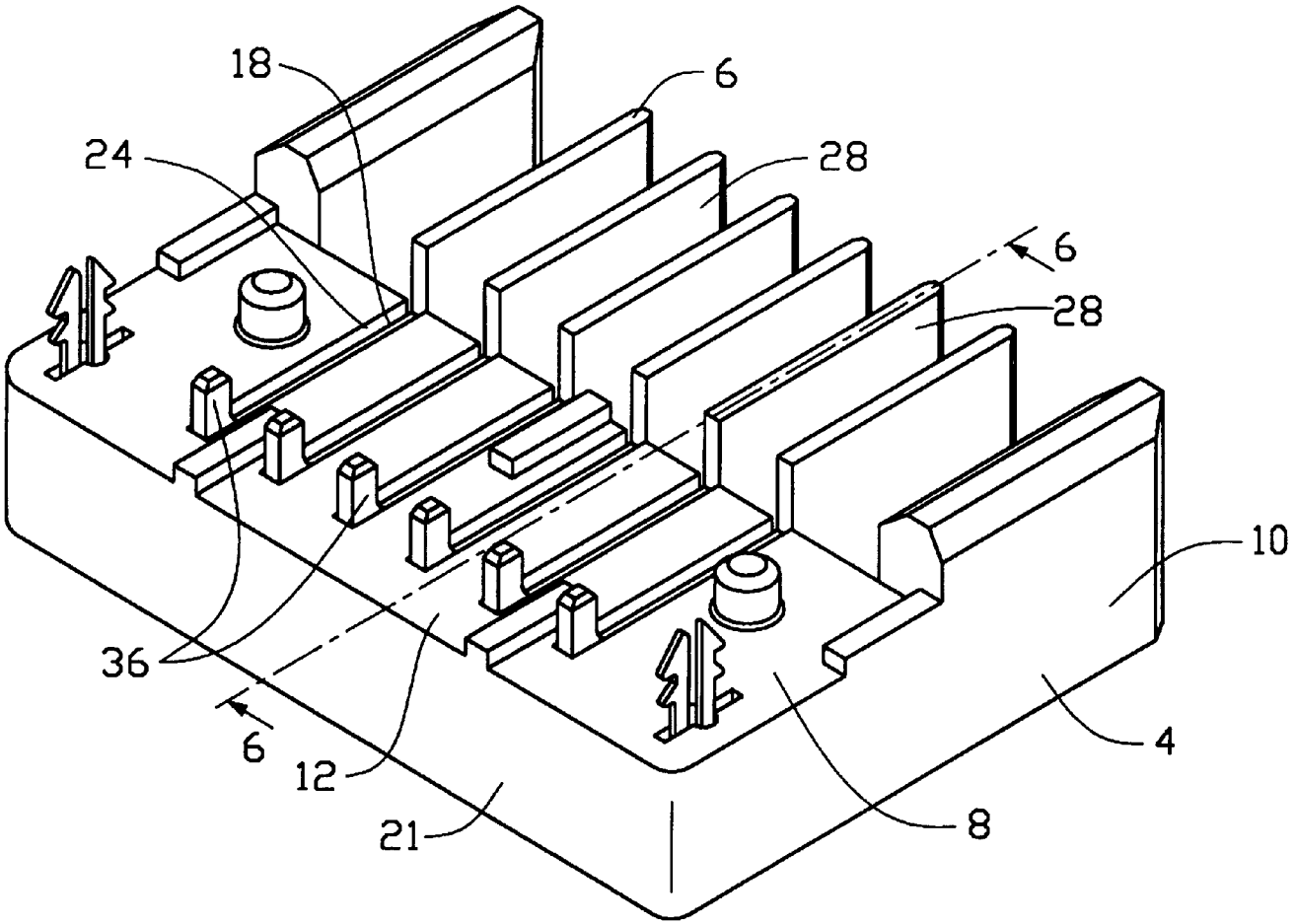
FIG. 5 is an assembled view of FIG. 2.
Figure 6:
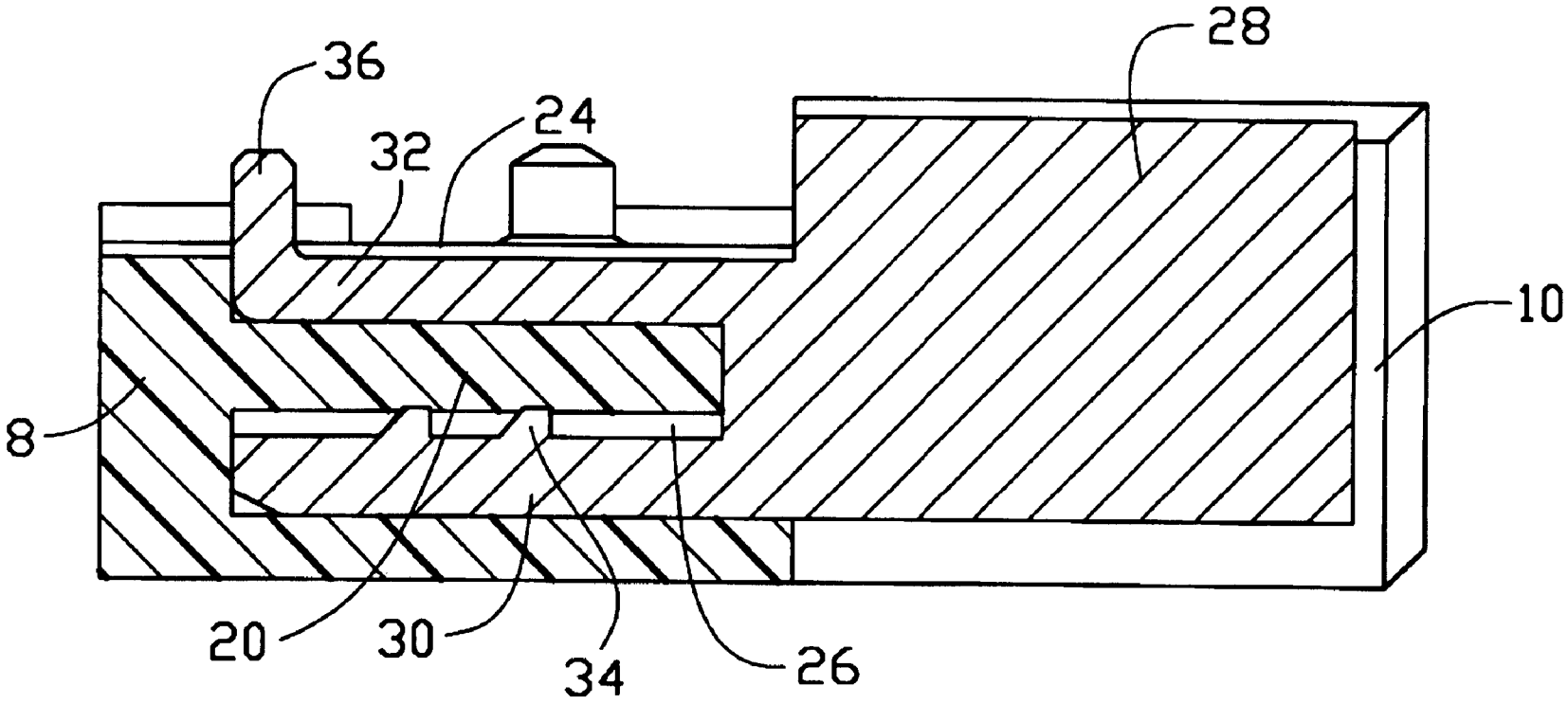
FIG. 6 is a cross sectional view taken along line 6—6 of FIG. 5.

Referring to FIGS. 5 and 6, in assembly, the contact tail 32 and the fixing post 30 of each contact 6 are inserted into the first and the second chambers 24, 26, respectively. Since the cavities 18 do not traverse the closed rear face 21 of the base portion 8 and there is a partition 20 in each cavity 22, the base portion 8 is not easily deformed for facilitating receiving contacts 6. The barbs 34 of the fixing post 30 interferentially engage with the partition 20 of the housing 4 for fixing the contact 6 in the housing 4. The terminating portion 36 projects beyond the mounting surface 12 for electrically connecting with the printed circuit board. The blade portion 28 of the contact 6 is positioned between the arms 10 of the housing 4 for mating with the complementary connector.

It is understood that the invention may be embodied in other specific forms without departing from the spirit of the central characteristics thereof. Thus, the present example and embodiment is to be considered in all respects as illustrative and not restrictive, and the invention is not to be limited to the details given herein.

What is claimed is:

1. An electrical connector comprising:

a housing including a base portion which has a mounting surface adapted for being mounted onto a board, the base portion defining a plurality of cavities in the mounting surface, a partition being formed in each cavity, the partition dividing the corresponding cavity into a first chamber and a second chamber, the second chamber being exposed to the mounting surface; and a plurality of contacts each including a blade portion, a fixing post and a contact tail, both the fixing post and the contact tail extending from an edge of the blade portion, the contact tail being received in the first chamber, the fixing post being received in the second chamber and engaging with the partition, thereby securing the contact in the housing;

wherein the partition is generally positioned in an intermediate portion of each cavity;

wherein the partition extends in a front-to-rear direction of each cavity and is spaced a predetermined distance from a front face of the base;

wherein the contact tail and the fixing post are parallelly aligned and a gap is defined therebetween, the gap being substantially smaller than the width of the partition;

wherein the contact tail has a terminating portion perpendicularly extending from a free end thereof for contacting a printed circuit board;

wherein the fixing portion forms at least one barb extending toward the contact tail.

* * * * *